US011826786B2

(12) United States Patent
Betz et al.

(10) Patent No.: US 11,826,786 B2
(45) Date of Patent: Nov. 28, 2023

(54) CLASSIFIER WHEEL WITH VANE SURFACE ELEMENTS

(71) Applicant: GEBR. PFEIFFER SE, Kaiserslautern (DE)

(72) Inventors: Michael Betz, Frankenthal (DE); Florian Gehrke, Olsbrücken (DE); Burkhard Kraft, Kaiserslautern (DE); Werner Hollstein, Münchweiler (DE)

(73) Assignee: GEBR. PFEIFFER SE, Kaiserslautern (DE)

( * ) Notice: Subject to any disclaimer, the term of this patent is extended or adjusted under 35 U.S.C. 154(b) by 0 days.

(21) Appl. No.: 17/778,673

(22) PCT Filed: Nov. 18, 2020

(86) PCT No.: PCT/EP2020/082550
§ 371 (c)(1),
(2) Date: May 20, 2022

(87) PCT Pub. No.: WO2021/099396
PCT Pub. Date: May 27, 2021

(65) Prior Publication Data

US 2022/0410212 A1 Dec. 29, 2022

(30) Foreign Application Priority Data

Nov. 22, 2019 (EP) ..... 19210946

(51) Int. Cl.
*B07B 7/08* (2006.01)
*B07B 7/083* (2006.01)

(52) U.S. Cl.
CPC ..... *B07B 7/083* (2013.01)

(58) Field of Classification Search
CPC ..... B07B 7/083; B07B 7/08
See application file for complete search history.

(56) References Cited

U.S. PATENT DOCUMENTS 5,511,668 A * 4/1996 Keuschnigg ..... B07B 11/06 209/714
5,533,629 A * 7/1996 Ito ..... B07B 7/083 209/714

(Continued)

FOREIGN PATENT DOCUMENTS

CN 102300647 A 12/2011
DE 1229371 B 11/1966

(Continued)

OTHER PUBLICATIONS

Webster's II New Riverside University Dictionary, The Riverside Publishing Company, 1984, p. 78. 1984 (Year: 1984).*

(Continued)

*Primary Examiner* — Patrick H Mackey
(74) *Attorney, Agent, or Firm* — Fitch, Even, Tabin & Flannery LLP

(57) ABSTRACT

A classifier wheel (2) for a classifier device (1) for classifying milled comminuted product, in particular of particulate bulk material, is disclosed herein. The classifier wheel (2) includes classifier wheel blades (5), which are arranged in the radially outer region of the classifier wheel (2), and vane surface elements (8), which are arranged radially spaced apart from the classifier wheel blades (5) in the radially inner region of the classifier wheel (2). A method of classifying milled comminuted products and a use of vane surface elements (8) for classifying milled comminuted products are also disclosed.

23 Claims, 3 Drawing Sheets

FIG. 5

(56) References Cited

U.S. PATENT DOCUMENTS

| | | | | |
|---|---|---|---|---|
| 5,791,490 | A * | 8/1998 | Heinemann | B07B 7/083 209/148 |
| 6,902,126 | B2 * | 6/2005 | Chen | B07B 7/083 241/80 |
| 7,900,779 | B2 * | 3/2011 | Kolacz | B07B 7/083 209/714 |
| 8,033,399 | B2 * | 10/2011 | Pistorius | B07B 7/083 209/208 |
| 9,004,285 | B2 * | 4/2015 | Tanaka | G03G 9/0817 209/718 |
| 11,117,167 | B2 * | 9/2021 | Galk | B07B 7/083 |

FOREIGN PATENT DOCUMENTS

| | | | |
|---|---|---|---|
| EP | 0645196 | A1 | 3/1995 |
| EP | 0983802 | A2 | 3/2000 |
| WO | 2017/067913 | A1 | 4/2017 |

OTHER PUBLICATIONS

Extended European Search Report dated May 29, 2020, in corresponding European Application No. 19210946.0, with machine English translation (24 pages).

International Search Report and Written Opinion dated Feb. 24, 2021, in corresponding International Application No. PCT/EP2020/082550, with machine English translation (21 pages).

International Preliminary Report on Patentability dated May 17, 2022, in corresponding International Application No. PCT/EP2020/082550, with English translation (17 pages).

Office Action and Search Report with English translation issued in related Chinese Application No. 202080080637X dated Mar. 6, 2023, 30 pages.

* cited by examiner

CLASSIFIER WHEEL WITH VANE SURFACE ELEMENTS

CROSS REFERENCE TO RELATED APPLICATIONS

This patent application is the national phase of PCT/EP2020/082550, filed Nov. 18, 2020, which claims the benefit of European Patent Application No. 19210946.0, filed Nov. 22, 2019.

TECHNICAL FIELD

The present invention relates to a classifier wheel for a classifier device for classifying milled comminuted products, in particular particulate bulk material, wherein the classifier wheel comprises classifier wheel blades which are arranged in the radially outer region of the classifier wheel.

BACKGROUND

WO 2017/067913 A1 discloses a classifier device with a rotor cage rotatable about an axis of rotation oriented essentially vertically and whose surface area is formed by rotor blades. A plurality of guide elements follow the rotor blades and extend in the radial direction in particular with a tangential component inwards towards the rotor axis and into the rotor cage. Here, the guide elements in some embodiments extend to the axis of rotation of the rotor cage, not however, into the radially inner region near the opening of the discharge of the undersized material. EP 0 645 196 A1 discloses a pneumatic turbulence classifier with a rotor, eddy flow adjustment plates, and a flow directing blade. EP 0 983 802 A2 discloses a classifier wheel with a disc supporting a classifier wheel hub and an annual cover disc.

SUMMARY

The object of the present invention is to provide an advantageous arrangement of vane surface elements in a classifier wheel, in particular in view of separation efficiency and energy efficiency.

The invention provides a classifier wheel for a classifier device for classifying milled comminuted products, in particular particulate bulk material, comprising classifier wheel blades which are arranged in the radially outer region of the classifier wheel, and vane surface elements which are arranged in the radially inner region of the classifier wheel radially spaced apart from the classifier wheel blades. During a classifying operation, an airflow with milled comminuted products of different grain sizes carried therein flows from radially outside to radially inside into the rotating classifier wheel and through the classifier wheel blades to then be drawn off in the axial direction of the classifier wheel. The vane surface elements are designed to break up an otherwise generated potential eddy in the classifier wheel and thereby reduce the pressure loss in the classifier airflow. As in particular a different number of vane surface elements and classifier wheel blades is provided, the arrangement of vane surface elements with respect to the classifier wheel blades is not always uniform. This can result in different flow resistances for the flow of the classifier air through the classifier wheel blades in the circumferential direction of the classifier wheel. By the radial spacing of the vane surface elements from the classifier wheel blades in the radial direction of the classifier wheel, an essentially rotationally symmetric flow profile can be achieved in the classifier wheel blades. In particular, by the radial spacing of the vane surface elements from the classifier wheel blades, a gap between the vane surface elements and the classifier wheel elements can be present which ensures the influence of the vane surface elements on the flow profile through the classifier wheel blades to be kept low. Consequently, in the classifying space radially outside the classifier wheel blades, an essentially rotationally symmetric flow profile can be generated within the classifier wheel despite the vane surface elements, whereby a good separation and thereby in particular very high separation effects are achieved. A high separation effect ensures that milled comminuted products are separated essentially in the classifying space as of a certain grain size and can thus be supplied to another milling process.

The particulate bulk material is in particular milled rock material, for example limestone, gypsum, coal or claystone, mineral bulk material, for example cement or cement material, or recycled bulk material, for example recycled plastic concrete plate material, blast furnace slag, flue gas gypsum, or flue ash.

In particular, the classifier wheel can be employed for a bulk material mill, in particular for a rock mill, advantageously in a bowl mill crusher. Therein, milling is in particular caused by rotating a milling plate relative to milling rollers about a central axis of the milling plate so that the milling rollers roll off on a milling path of the milling plate about the roller's axis of rotation to thereby mill the particulate bulk material and reduce its grain sizes. However, other bulk material mills can also be employed in combination with the classifier wheel, in particular bulk material mills which initially generate grain size distributions that do not yet correspond to the desired grain size distribution of the final product. Then, a classifier device with the classifier wheel according to the invention is employed to separate particles with too large grain sizes in the comminuted product and supply them again to the milling process. Advantageously, the angle of inclination of the vane surface elements with respect to the axial direction of the classifier wheel in the area spanned by the axial direction and the circumferential direction of the classifier wheel is constant along the total axial extension of the vane surface elements. Thereby, a radial eddy current generated by the rotation of the classifier wheel can be broken up more efficiently. In particular, the vane surface elements extend linearly in the axial direction of the classifier wheel. Furthermore, the vane surface elements in particular extend in an area spanned by the axial direction and the radial direction of the classifier wheel.

In order to enhance a uniform flow condition in the classifying space and within the classifier wheel desired in the axial direction, it is particularly advantageous for the radial distance between the radially inner end of the classifier wheel blades and the radially outer end of the vane surface elements to be constant along the total axial extension of the classifier wheel.

In one preferred embodiment, the radial distance between the radially inner end of the classifier wheel blades and the radially outer end of the vane surface elements is at least 3% of the diameter of the classifier wheel, preferably at least 5%. In particular, the radial distance is at most 30%, preferably at most 20%, of the diameter of the classifier wheel. These ratios of dimensions represent an advantageous compromise between a reduction of the potential eddy and an essentially rotationally symmetric flow profile in the classifier wheel gap.

In one embodiment, the vane surface elements extend linearly in the radial direction of the classifier wheel.

In one preferred embodiment, the vane surface elements are designed to be bent and/or inclined at least partially with respect to the radial direction of the classifier wheel. Here, in particular the radially outer edge of the vane surface element is set back trailing with respect to the provided sense of rotation of the classifier wheel, that means in particular against the sense of rotation in the circumferential direction. The curved and/or inclined design of the vane surface elements permits to optimize the flow behavior for reducing the flow resistance in the direction of the discharge opening of the classifier wheel. In particular, potential eddies can be further reduced thereby.

In one embodiment, the classifier wheel blades are designed to be curved and/or inclined at least partially with respect to the radial direction of the classifier wheel, the inclination of the vane surface elements with respect to the radial direction being larger at least at their radially outer edge than the inclination of the classifier wheel blades with respect to the radial direction at least at their radially inner edge. Thereby, an advantageous flow profile between the classifier wheel blades can be generated.

In one embodiment, the radially outer edge of the vane surface elements is designed to be curved and/or inclined at least partially with respect to the axial direction of the classifier wheel. Thereby, the flow can be supported or reduced in the direction of the discharge opening in the axial direction to provide the desired flow condition in the classifying space and within the classifier wheel.

The vane surface elements are in particular formed of a rigid flat material, for example steel sheet. The vane surface elements, however, can also have a thickness varying along their extension, for example to optimize the flow conditions thereat.

In particular, the vane surface elements can be at least partially arranged at their radially inner end at a central shaft in the classifier wheel. In particular, the classifier wheel can be mounted via the central shaft. The central shaft can be a solid or a hollow shaft. The provision of the central shaft and the direct connection of the vane surface elements to it in particular takes care that no eddy can occur in the center of the classifier wheel.

In one embodiment, the vane surface elements can be guided to the radial center of the classifier wheel. Thereby, the size of the vane surface elements can be maximized.

As an alternative, a distance between a centrally arranged shaft and the vane surface elements can be provided. This can permit a flow between the regions separated by the vane surface elements in the radially inner region of the classifier wheel.

Advantageously, the vane surface elements are uniformly distributed in the classifier wheel in the circumferential direction. Thereby, uniform flow conditions can be achieved in the classifier wheel, whereby in turn uniform flow conditions in the classifying space are enhanced.

In particular, at least 4 vane surface elements are provided. In some embodiments, more than 6, 8, 10, 12, 14 or 16 vane surface elements can also be provided. The larger the diameter of the classifier wheel is, the more vane surface elements in particular make sense here.

In one embodiment, the vane surface elements at least partially extend over the total height of the interior of the classifier wheel. Thereby, in particular in the region of the axial discharge opening, the occurrence of eddies can be prevented.

Advantageously, the distance between the radially inner end of the classifier wheel blades and the radially outer end of the vane surface elements is adjustable. This can be permitted in particular by a radial moveability of the classifier wheel blades and/or the vane surface elements. In particular, the classifier wheel blades and/or vane surface elements can be movably provided in slots in support plates at the axial ends of the classifier wheel. In particular, an attachment by screwing can be provided. In some embodiments, it is also possible to adjust the classifier wheel blades and/or vane surface elements in the circumferential direction.

In particular, the vane surface elements can only extend to a region of the classifier wheel adjacent to the discharge opening.

The invention furthermore provides a classifier device for classifying milled comminuted products, in particular for classifying particulate bulk material, comprising the classifier wheel according to the invention and a vane ring within which the classifier wheel is rotatably arranged, wherein a classifying space is formed between the vane ring and the classifier wheel. In the classifying space, the separation of coarse material from the classifier air is mainly accomplished by said material falling downwards out of the classifier airflow under the influence of gravity.

The invention furthermore provides a system for milling feed material in the form of particulate bulk material, comprising a bulk material mill, in particular a bowl mill crusher, and a classifier device as defined above. The classifier device is here in particular arranged above the bulk material mill, wherein particulate bulk material is transported by means of the classifier air from the bulk material mill to the classifier device.

Advantageously, a discharge line is arranged centrally above the classifier wheel. Advantageously, the classifier wheel comprises, in its radially inner region, a discharge opening, so that the interior of the classifier wheel is connected with the discharge line and the classifier air can correspondingly convey undersized material from the classifier wheel into the discharge line. In alternative embodiments, the discharge line can also be arranged under the classifier wheel.

The invention provides a method for classifying milled comminuted products, in particular of particulate bulk material, wherein milled comminuted product is supplied into a classifying space surrounding a rotating classifier wheel, and an airflow is provided which flows radially inside into the rotating classifier wheel and is then discharged in the axial direction through a discharge opening in the classifier wheel, wherein the airflow carries along a portion of the comminuted product in the axial direction along vane surface elements in the region of the classifier wheel adjacent to the discharge opening. This in particular means that vane wheel surfaces are provided in the region of the classifier wheel adjacent to the discharge opening, so that no eddy can occur within the classifier wheel which would deteriorate the discharge of the undersized material in the classifier air out of the classifier wheel.

In the method, the radial distance between the radially outer end of the vane surface elements and the radially inner end of classifier wheel blades of the classifier wheel can optionally be adjusted in response to the speed and/or diameter of the classifier wheel. This can be done by an automatic adjustment of the vane surface elements and/or the classifier wheel blades in the radial and/or circumferential direction by actuators controlled by a controller. This can in particular be done during the operation and in response to the operating states, in particular the speed and/or the output. As an alternative, an adjustment can also be effected manually during operation breaks.

In a preferred embodiment, the airflow between the classifier wheel blades is embodied to be rotationally symmetric. In particular, in all spaces between classifier wheel blades arranged at equal distances one next to the other, there is an identical flow condition. This permits a uniform separation of oversized material in the classifying space.

The invention furthermore provides a method for classifying milled comminuted products, in particular particulate bulk material, wherein milled comminuted product is supplied to a classifying space surrounding a rotating classifier wheel, and an airflow is provided which flows radially inwards through radially outer classifier wheel blades into the rotating classifier wheel and then flows in the axial direction along radially inner vane surface elements, wherein in all spaces between classifier wheel blades arranged at equal distances one next to the other, there is an identical flow condition. This is in particular achieved by a radial spacing of the vane surface elements from the classifier wheel blades. In particular, all classifier wheel blades can be arranged at equal distances with respect to each other.

The invention provides a use of vane surface elements in the classification of milled comminuted products, in particular of particulate bulk material, wherein the vane surface elements are arranged in the radially inner region of a classifier wheel, so that they are exposed to the flow of air in the circumferential direction of the airflow guided through the classifier wheel and are thereby used to recover energy from the flow of air for the rotation of the classifier wheel. That means that the vane surface elements and in particular the classifier wheel blades are arranged or inclined such that the pressure on the back side of the vane surface elements in the direction of rotation of the classifier wheel is higher than the pressure on the front side of the vane surface elements in the direction of rotation.

BRIEF DESCRIPTION OF THE DRAWINGS

The invention will be further illustrated below with reference to exemplary embodiments which are represented in the following figures. In the figures.

DETAILED DESCRIPTION

Figure 1:
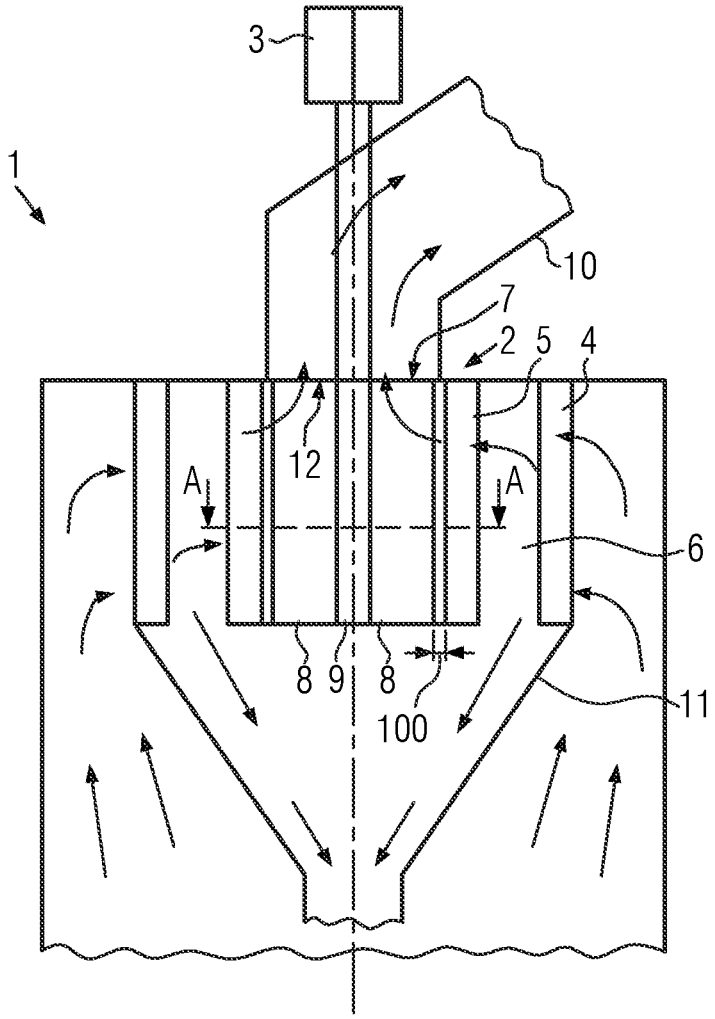
FIG. 1 shows a lateral sectional view of a classifier device according to an embodiment of the present invention.

In FIG. 1, a classifier device 1 according to an embodiment of the invention is shown. The classifier device 1 permits to separate oversized material from undersized material in a classifier airflow, to supply the oversized material again to a milling process, and to carry away the undersized material for further processing. To this end, a classifier wheel 2 is provided which can be rotated about a vertical axis by means of a motor 3. The classifier wheel 2 is arranged within a vane ring 4. Here, an outer ring of classifier wheel blades 5 of the classifier wheel is radially spaced apart from the vane ring 4, so that between the classifier wheel blades 5 and the vane ring 4, a classifying space 6 is formed. A milled comminuted product, in particular particulate bulk material, is carried along by an airflow from radially outside through a vane ring 4 and then enters the classifying space 6. By the rotation of the classifier wheel blades 5 together with the classifier wheel 2, flow conditions are produced in the classifying space which cause coarse proportions of the milled comminuted products to fall downwards, and only comminuted products that have at least a certain fineness are transported radially to the inside into the classifier wheel 2. The classifier air flows through the classifier wheel blades 5 into the interior of the classifier wheel and then through a discharge opening 7 into a subsequent processing device. The subsequent processing device may only consist in the undersized material being piled up, transported further and/or packaged.

Between the vane surface elements 8 and the classifier wheel blades 5, a radial distance 100 is provided. Thereby, the effect of the vane surface elements 8 on the flow of the classifier air through the classifier wheel blades 5 can be reduced, so that a more uniform flow profile is present in the classifying space 6. Nevertheless, the vane surface elements prevent undesired potential eddies from occurring inside the classifier wheel 2, and can advantageously contribute to the energy recovery in view of the flow of the classifier air by reducing the required driving power of the motor 3.

In particular, the vane surface elements 8 are attached or at least connected to the shaft 9 of the classifier wheel. A discharge line for undersized material 10 is provided above the discharge opening 7 by which undersized material with the desired grain sizes is carried away in an airflow. The discharge line 10 is in particular arranged above the classifier wheel.

A funnel 11 can be arranged under the classifier wheel 2 and collect oversized material falling down from the classifying space 6 and supply it to a milling process. In particular, a milling plate can be arranged centrally under the funnel 11, so that the milling stock is centrally supplied to the rotating milling plate and then again comminuted by milling rollers before it is again caught by a classifier airflow and supplied to the classifier device 1. Thus, the milling stock or the comminuted products are guided through the classifier device 1 until the desired comminution stage is reached, so that the corresponding undersized material can pass the classifying space 6 into the interior of the classifier wheel and then be discharged via the discharge line 10.

As is represented in FIG. 1, the vane surface elements 8 extend directly to the discharge opening 7 of the classifier wheel 2. Thus, the classifier airflow in the classifier wheel 2 is guided through the vane surface elements 8 to its discharge opening 7. This prevents the generation of undesired eddies in the classifier wheel 2 and improves the energy recovery from the classifier airflow. The vane surface elements 8 extend over the total height of the classifier wheel 2.

Figure 2:
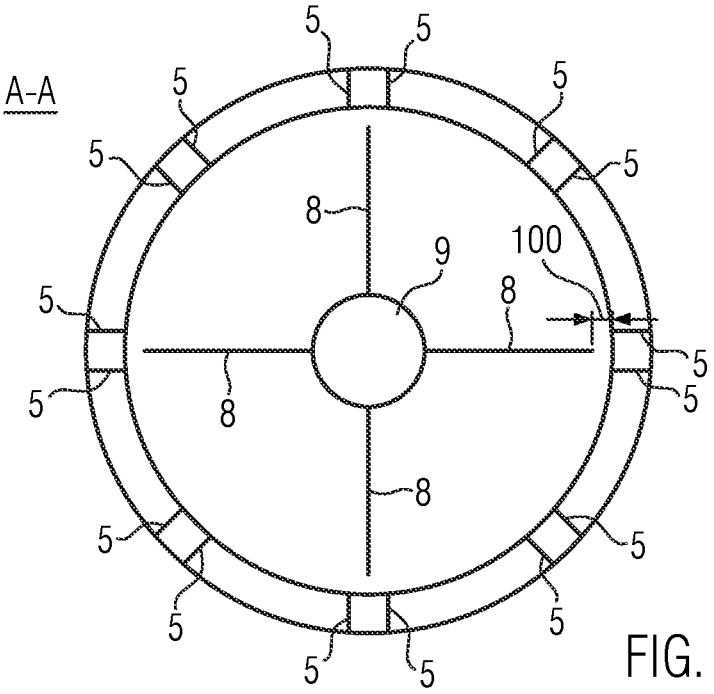
FIG. 2 shows a horizontal sectional view through the classifier wheel according to FIG. 1.

In FIG. 2, the horizontal sectional view A-A through the embodiment of the classifier wheel 2 according to the invention, which is drawn in in FIG. 1, is represented. This classifier wheel 2 includes a central shaft 9 with vane surface elements 8 extending from it in the axial direction. The classifier wheel blades 5 are arranged at a radial distance 100 from the radially outer ends 8 of the vane surface elements 8. The classifier wheel blades 5 are here slightly inclined each in pairs in opposite directions with respect to the radial direction. Furthermore, a higher number of classifier wheel elements 5 than of vane surface elements 8 is provided.

Figure 3:
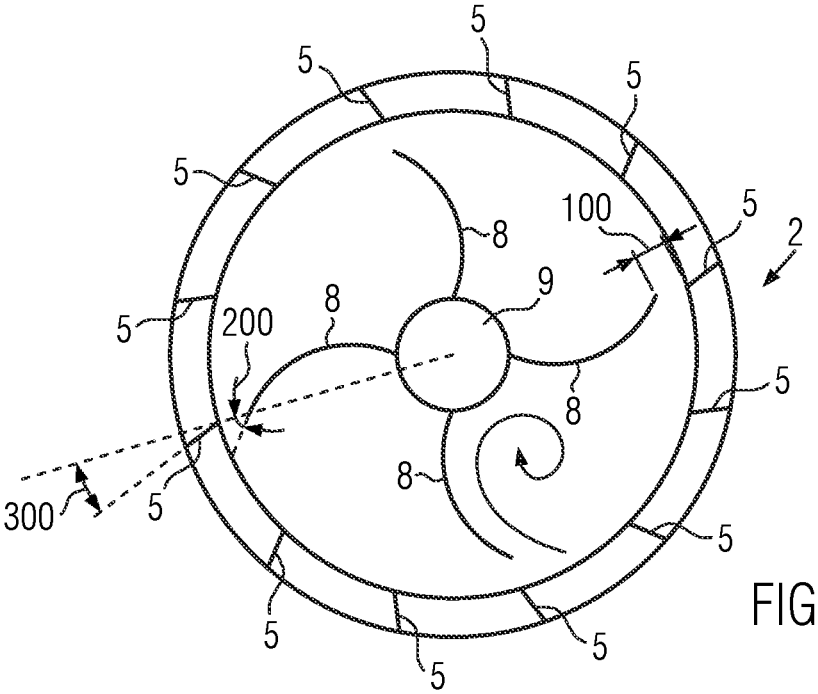
FIG. 3 shows a sectional view through a classifier wheel according to an embodiment of the invention.

In FIG. 3, a further embodiment of a classifier wheel 2 is represented in a horizontal sectional view. Here, the vane surface elements 8 are fitted with a corrugated profile. Here, the vane surface elements 8 are curved against the intended sense of rotation. That means that the vane surface elements each have different angles with respect to the radial direction over their extensions. Furthermore, the classifier wheel blades 5 are inclined with respect to the radial direction. Here, the angle 200 of the radially outer end of the vane surface elements 8 is larger than the angle 300 of the classifier wheel blades 5 with respect to the radial direction. This permits an advantageous flow profile in the classifying space 6, i.e. radially outside the classifier wheel blades 5.

Between the vane surface elements 8 eddies can still occur, as is indicated in FIG. 3 by way of example. However, these eddies are locally confined and thus cause a clearly lower pressure loss than the eddies in classifier wheels according to prior art.

Figure 4:
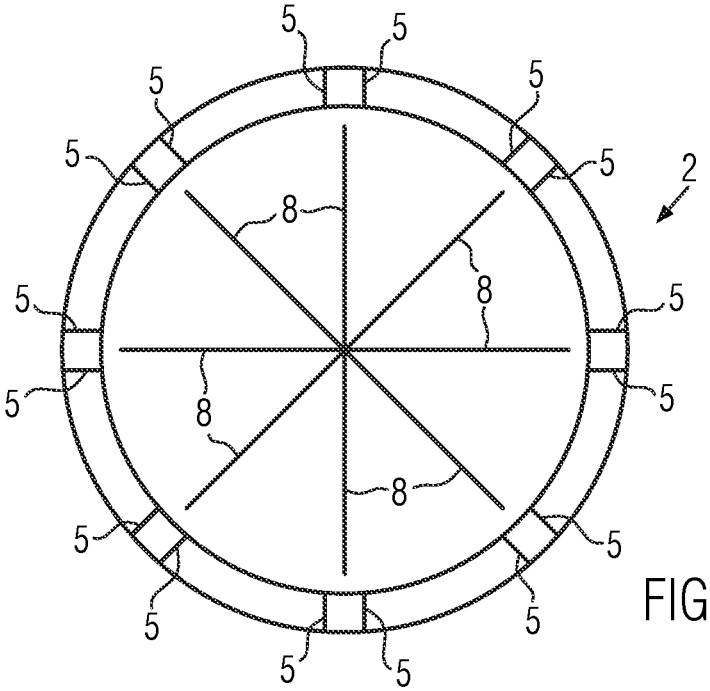
FIG. 4 shows a sectional view through a classifier wheel according to another embodiment of the invention.

In FIG. 4, an increased number of vane surface elements 8 is provided to further reduce the formation of eddies inside the classifier wheel 2. Furthermore, FIG. 4 shows, by way of example, how the vane surface elements can be guided to the radial center of the classifier wheel. This is in particular possible if in this region, no shaft 9 is provided, but the shaft is, for example, only flange-mounted axially outside at the classifier wheel 2.

Figure 5:
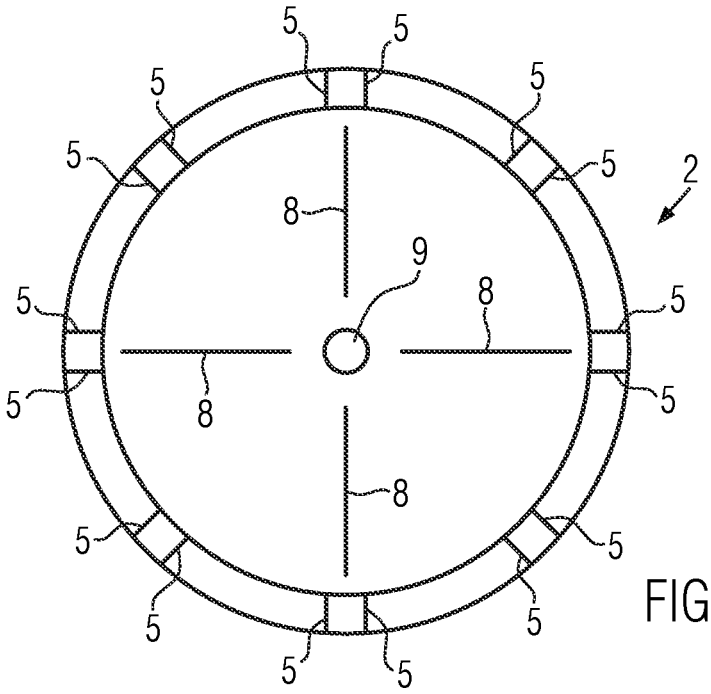
FIG. 5 shows a sectional view through a classifier wheel according to another embodiment of the invention.

In FIG. 5, a classifier wheel 2 is represented in which a radial distance between the centrally arranged shaft 9 and the vane surface elements 8 is provided. The vane surface elements arranged in the radially central region nevertheless permit an effective reduction of eddies, here, it can be, however, advantageous for the vane surface elements 8 to be guided to the central shaft 9 at least in the region which is adjacent to the discharge opening 7.

The vane surface elements 8 in FIGS. 2 to 5 each extend linearly in the axial direction of the classifier wheel 2.

Figure 6:
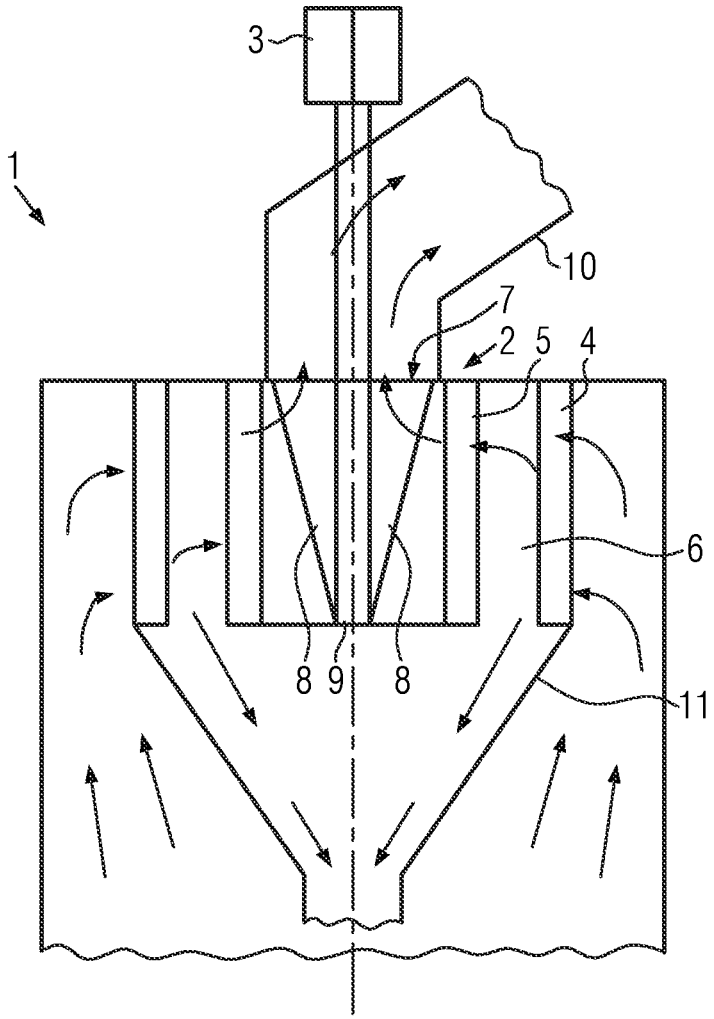
FIG. 6 shows a lateral sectional view through a classifier device according to a further embodiment of the invention.

In FIG. 6, an embodiment is finally shown in which the radially outer edge of the vane surface elements is inclined with respect to the axial direction. In particular, the surface of the vane surface elements 8 increases towards the discharge opening, so that in those regions where an increased flow of air is present, an effective suppression of air whirls is possible. As was shown above, the vane surface elements 8 cannot only be employed for suppressing eddy currents, but also be driven by the airflow and thus at least reduce the power input via the motor 3 for driving the classifier wheel. Moreover, by the spacing of the vane surface elements 8 from the classifier wheel blades 5, a reaction of the vane surface elements to the classifying space 6 can be reduced. It can in particular be prevented that a non-uniform flow of air is present in the circumferential direction in response to the vane surface elements 8 in the classifying space 6.

The invention claimed is:

1. A classifier wheel (2) for a classifier device for classifying milled comminuted products, the classifier wheel (2) comprising:

classifier wheel blades (5) arranged in a radially outer region of the classifier wheel (2); and vane surface elements (8) arranged radially spaced apart from the classifier wheel blades (5) in a radially inner region of the classifier wheel (2);

a discharge opening (7) arranged in a radially inner region of the classifier wheel (2) and configured to be positioned adjacent to a discharge line of the classifier device;

wherein an angle of inclination of the vane surface elements (8) is constant with respect to an axial direction of the classifier wheel (2) in an area spanned by the axial direction and a circumferential direction of the classifier wheel (2);

wherein the vane surface elements (8) extend to and terminate at or adjacent to the discharge opening (7) such that the vane surface elements (8) do not extend through the discharge opening (7) or into the discharge line of the classifier device.

2. The classifier wheel according to claim 1, wherein the vane surface elements (8) extend linearly in the axial direction of the classifier wheel (2).

3. The classifier wheel according to claim 1, wherein a radial distance between a radially inner end of the classifier wheel blades (5) and a radially outer end of the vane surface elements (8) is constant along a total axial extension of the classifier wheel (2).

4. The classifier wheel according to claim 1, wherein a radial distance between a radially inner end of the classifier wheel blades (5) and a radially outer end of the vane surface elements (8) is between 3% and 30% of a diameter of the classifier wheel (2).

5. The classifier wheel according to claim 1, wherein the vane surface elements (8) are designed to be curved and/or inclined at least partially with respect to a radial direction of the classifier wheel (2).

6. The classifier wheel according to claim 5, wherein the classifier wheel blades (5) are curved and/or inclined at least partially with respect to the radial direction of the classifier wheel (2), and wherein the inclination of the vane surface elements (8) with respect to the radial direction is larger, at least at radially outer edges of the vane surface elements (8), than the inclination of the classifier wheel blades (5) with respect to the radial direction at least at radially inner edges of the classifier wheel blades (5).

7. The classifier wheel according to claim 1, wherein a radially outer edge of the vane surface elements (8) is curved and/or inclined at least partially with respect to the axial direction of the classifier wheel (2).

8. The classifier wheel according to claim 1, wherein the vane surface elements (8) are at least partially arranged at a central shaft (9) in the classifier wheel (2) at radially inner ends of the vane surface elements (8).

9. The classifier wheel according to claim 1, wherein the vane surface elements (8) extend to a radial center of the classifier wheel (2).

10. The classifier wheel according to claim 1, wherein the vane surface elements (8) are uniformly distributed in the classifier wheel in the circumferential direction.

11. The classifier wheel according to claim 1, wherein the vane surface elements (8) at least partially extend over a total height of an interior of the classifier wheel (2).

12. The classifier wheel according to claim 1, wherein a distance between a radially inner end of the classifier wheel blades (5) and a radially outer end of the vane surface elements (8) is adjustable.

13. The classifier wheel according to claim 1, wherein the vane surface elements (8) comprise at least six vane surface elements (8).

14. A classifier device for classifying milled comminuted products, the classifier device comprising:

the classifier wheel (2) according to claim 1; and a vane ring (4) inside of which the classifier wheel (2) is rotatably arranged, wherein a classifying space (6) is embodied between the vane ring (4) and the classifier wheel (2).

15. The classifier device according to claim 14, wherein the discharge line (10) is arranged centrally above the classifier wheel (2).

16. A method for classifying milled comminuted products, including the steps of:

supplying the milled comminuted product into a classifier space (6) surrounding a rotating classifier wheel (2), and providing an airflow which flows radially inwardly into the rotating classifier wheel (2) and is then discharged in an axial direction through a discharge opening (7) in the classifier wheel (2) positioned adjacent to a discharge line of a classifier device, wherein the airflow carries along a portion of the milled comminuted product in the axial direction along vane surface elements (8) in a region of the classifier wheel (2) adjacent to the discharge opening (7), wherein an angle of inclination of the vane surface elements (8) is constant with respect to the axial direction of the classifier wheel (2) in an area spanned by the axial direction and a circumferential direction of the classifier wheel (2), wherein the vane surface elements (8) extend to and terminate at or adjacent to the discharge opening (7) such that the vane surface elements (8) do not extend through the discharge opening (7) or into the discharge line of the classifier device.

17. The method according to claim 16, wherein the classifier wheel (2) comprises classifier wheel blades (5) arranged in a radially outer region of the classifier wheel (2), and the vane surface elements (8) are arranged in a radially inner region of the classifier wheel (2) radially spaced apart from the classifier wheel blades (5).

18. The method according to claim 17, further comprising adjusting a radial distance between a radially outer end of the vane surface elements (8) and a radially inner end of classifier wheel blades (5) of the classifier wheel (2) in response to a speed and/or a diameter of the classifier wheel (2).

19. The method according to claim 17, wherein the airflow between the classifier wheel blades (5) is rotationally symmetrical.

20. The method according to claim 17, wherein a radial distance between a radially inner end of the classifier wheel blades (5) and a radially outer end of the vane surface elements (8) is constant along a total axial extension of the classifier wheel (2).

21. The method according to claim 16, wherein the vane surface elements (8) extend linearly in the axial direction of the classifier wheel (2).

22. The method according to claim 16, wherein the vane surface elements (8) extend to a radial center of the classifier wheel (2).

23. The method according to claim 16, wherein the vane surface elements (8) comprise at least six vane surface elements (8).

* * * * *